US007233223B2

(12) United States Patent
Darmann

(10) Patent No.: US 7,233,223 B2
(45) Date of Patent: Jun. 19, 2007

(54) TRANSFORMER WINDING

(75) Inventor: Francis Anthony Darmann, New South Wales (AU)

(73) Assignee: Metal Manufactures Limited, Gordon, New South Wales (AU)

( * ) Notice: Subject to any disclaimer, the term of this patent is extended or adjusted under 35 U.S.C. 154(b) by 49 days.

(21) Appl. No.: 10/803,780

(22) Filed: Mar. 18, 2004

(65) Prior Publication Data

US 2004/0174643 A1 Sep. 9, 2004

(51) Int. Cl.
*H01F 27/28* (2006.01)
*H01F 27/34* (2006.01)

(52) U.S. Cl. ..... 336/180; 336/182; 336/181; 335/299

(58) Field of Classification Search ..... 335/216, 335/296, 299; 336/180–184
See application file for complete search history.

(56) References Cited

U.S. PATENT DOCUMENTS 4,239,077 A * 12/1980 Dixon et al. ..... 156/273.5
4,864,266 A * 9/1989 Feather et al. ..... 336/150
5,581,220 A * 12/1996 Rodenbush et al. ..... 335/216
5,604,473 A * 2/1997 Rodenbush ..... 335/216
5,914,647 A * 6/1999 Aized et al. ..... 335/216
6,081,987 A * 7/2000 Kalsi et al. ..... 29/599
6,925,316 B2 * 8/2005 Rey ..... 505/211

FOREIGN PATENT DOCUMENTS

| | | | |
|---|---|---|---|
| EP | 0286980 | | 10/1988 |
| EP | 0339934 | | 11/1989 |
| JP | 02228005 A | * | 9/1990 |
| JP | 06132143 | | 5/1994 |
| JP | 10214713 A | * | 8/1998 |
| JP | 10284335 | | 10/1998 |

* cited by examiner

*Primary Examiner*—Anh Mai
(74) *Attorney, Agent, or Firm*—Fay Kaplun & Marcin, LLP

(57) ABSTRACT

A Winding for high voltage transformer having a predetermined number of spaced winding groups joined to form a single winding transformer, each spaced winding group being solenoid wound from a predetermined number of turns. A method of forming the winding and a transformer including the winding are also disclosed.

15 Claims, 2 Drawing Sheets

PRIOR ART

TRANSFORMER WINDING

FIELD OF THE INVENTION

The present invention relates to a method of forming windings in high voltage transformers and the transformer winding resulting from such a method.

BACKGROUND ART

Any discussion of the prior art throughout the specification should in no way be considered as an admission that such prior art is widely known or forms part of common general knowledge in the field.

The conventional windings in transformer coils for the most common high voltage transformers (132 kv: 11 kV or similar) use a disk type winding. In this winding, the wound cable consists of a number of insulated conductors (up to 32, but usually 4 to 8). The conductors are transposed so that each presents the same impedance to the line to ensure a uniform current distribution among the conductors within the cable.

A disk type winding is employed so that the voltage is across the-coil is distributed evenly from top to bottom and that no two disks experience a greater voltage stress than any other disk under normal operating conditions. This type of winding is shown schematically in FIG. 1. In this type of winding the turns 5 of the winding lie on top of each other to form an axially extending disk 6 rather than cylinder formed in a typical solenoid type winding. As shown, the top disk 7 of the coil is at a higher voltage, and the bottom of the disk will be at zero voltage in a star-type connected three-phase transformer, or at the line voltage in a delta-type connected transformer. The disk windings are connected without the need for joints or brazing of any kind, at one end in an alternating manner down the height of the disk stack.

The primary coil (high voltage side) is usually wound in this manner, and the secondary coil is usually wound in a single layer solenoid type winding, because its voltage is less (11 kV), and so does not suffer the same electric stresses. However, if a second layer is required, it cannot be placed on top of the first and is usually placed a sufficient distance away with appropriate press board spacers and oil ducts sufficient to meet the inter-layer voltage stress and cooling requirements.

Solenoid type windings typically consist of a conductor wound so that the turns of the conductor lie side by side to form a helical layer (usually cylindrical), once a layer is completed, further layers may be wound over the first layer in a reciprocal manner until the desired number of layers is formed.

Transformers are not designed to only meet their normal operating voltage stresses. The clearances are decided so that the transformer can withstand the voltage stresses at the prescribed testing conditions set out in the local standards. For example, in the Australian standard, the clearances and barriers must be designed to withstand approximately twice the voltage stress at the power frequency (the so called power frequency or AC test) and an appropriate lightning impulse test. For a 132 kV transformer, the peak of the lightning impulse test will be 550 kV or 650 kV as specified by the customer.

For the above reasons, it is not practical to wind the high voltage primary coil as a solenoid because the voltage stress between the layers at the top and bottom of the coils is high, and increases in proportion with the number of layers times the number of turns per layer. The worst case normal voltage stress will be between the first turn and the last turn at the top of the winding which will have the full 132 kV normal voltage across the annular thickness of the coil (defined as the difference in the outside radius and inside radius of the coil) and under test conditions, significantly more depending on the test. Hence, disk windings are used. A solenoid-type winding is shown in FIG. 2 where the conductor 10 is wound to and fro vertically to form a number of vertically extending layers 11.

In a disk winding the greatest voltage stress during any test is between the top two disks, but these only have a fraction of the total turns in them, so the voltage will only be of the order of kilovolts or tens of kilovolts during L1, not the full 230 (AC test) or 550 kV (L1).

Disk windings require significant handling and physical contortions of the disks and individual copper conductors in order to be wound in a single length in a neat and tidy manner suitable for transformer coils. For example, each second disk must be turned inside out after winding (so that the inner turn becomes the outer and outer one becomes the inner). This is to facilitate winding in a continuous manner, not to ensure transpositioning. In addition, the conductors must be kinked in plane parallel to the width of the conductor in order to go from one disk to the other.

The abovementioned disadvantages are of more concern in the field of High Temperature Superconductors (HTS). It is most likely that HTS transformers will only replace those very large transformers where the savings in weight and size justify the cooling overhead. Hence, the discussion is limited to those cases where the primary voltage is at 110 kV or greater (132, 230, 350, 500 kV for example), however, it will be appreciated the invention is also applicable to other high voltage windings.

HTS conductors cannot be subjected to the level of mechanical manipulation which copper conductors are subjected to during the winding of transformer coils. The unit length of HTS may also not be available in more than 1000 m lengths which means a completely continuous HTS winding is not possible.

One way to wind a high voltage HITS primary coil and avoid the above-mentioned manipulations is to use a series of electrically connected double pancakes. A pancake is analogous to a disk type winding. The double pancakes could be then connected in series with normal conductors or other HTS conductors with resistive joints. Double pancakes must be used instead of single pancakes to avoid connections that run down the side of the plane of each pancake. Double pancakes allow connections to be all on the outside or inside of the stack avoiding cross leads traversing down the radial length of the coils which will pick up flux.

The disadvantage of this type of arrangement, however, is that in large transformers, the number of connections could be quiet large and approach hundreds. The connections are sources of dissipation which add to the losses, and can be sources of bubbling in liquid nitrogen, or thermal instabilities in other types of cooled methods due to the concentrated nature of the loss.

Another way to wind a high voltage coil is to use a continuous solenoid type winding. However, as stated above, this results in a high voltage stress across a short creep distance at the top of the coil. This is further compounded by the fact that HTS windings have significantly less annular thickness and so the electrical stress is increased many fold.

The voltage between layers within the winding is of not much concern because the interlayer insulation is a solid dielectric, preferably Kapton™, which has a high breakdown strength (>80<90 kV/mm at 77K) sufficient to meet the test requirements. However, at the top end of the coil, the layer to layer voltage stress can breakdown along a creepage path 20 through the liquid nitrogen or gaseous nitrogen where no solid dielectric exists. Gaseous nitrogen at 77 K has a corona on-set point of just 5 kV for distances of between 10 and 30 mm and all liquid nitrogen cooled coils will have a gaseous portion above the liquid.

The addition of a solid inter-layer dielectric which extends beyond the top of each layer is possible, however, the liquid nitrogen would still have significant stress because it has the lower relative dielectric constant (1.4 at 77K compared to 3.0 to 3.6 for Kapton™).

The interlayer dielectric would have to be very thick or very long to the extent where the complete winding becomes very large.

Manufacturers typically take significant and costly precautions to pass the lightning impulse test. The additional benefit of a solenoid type winding is that the L1 pulse is distributed more uniformly between the layers within each solenoid and so can prevent the requirement for a shielding winding or an interleaved winding. In a disk winding, without shielding windings or interleaved windings, the L1 produces a very large stress between the top two disks and would fail without the countermeasures in place. However, these countermeasures are expensive to wind, and complicate the winding considerably.

DISCLOSURE OF THE INVENTION

It is an object of the present invention to overcome or ameliorate at least one of the abovementioned disadvantages of the prior art, or to provide a useful alternative.

According to one aspect, the present invention provides a method of producing a winding for a high voltage transformer including the steps of:

forming a predetermined number of spaced conductor winding groups joined to form a single winding of the transformer, winding each spaced winding group as a solenoid-type winding from a predetermined number of turns of conductor.

According to a further aspect, the present invention provides a winding for high voltage transformer having a predetermined number of spaced winding groups joined to form a single winding of the transformer, each spaced winding group being solenoid wound from a predetermined number of turns.

Preferably, the number of spaced winding groups and number of turns of each winding group are selected such that a predetermined voltage stress for a given operating voltage of the transformer is not exceeded.

For preference, the winding uses high temperature superconductors. Preferably, each winding group is formed from a single uninterrupted length of conductor, that is, the length of conductor is not joined in any manner. Each conductor turn may consist of a plurality of conductors.

For preference, the winding groups are spaced and stacked vertically. Preferably, each winding group is wound in sequence vertically.

In another aspect, the present invention provides a transformer including a winding according to the second aspect. Preferably, the transformer is a superconducting transformer.

BRIEF DESCRIPTION OF DRAWINGS

A preferred embodiment of the invention will now be described, by way of example only, with reference to the accompanying drawings in which.

DESCRIPTION OF PREFERRED EMBODIMENT

Figure 1:
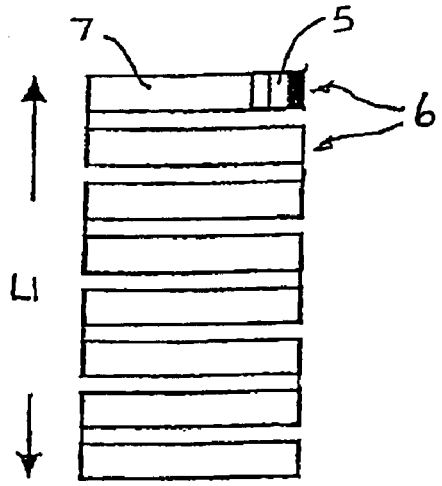
FIG. 1 shows a cross-sectional schematic view of one side of a conventional disk winding.
Figure 2:
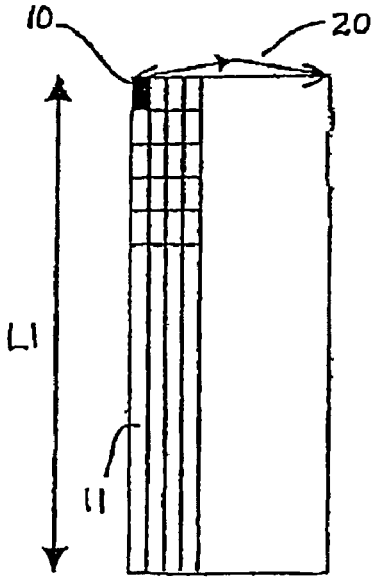
PRIOR ART Figure 2.
FIG. 2 shows a cross-sectional schematic view of one side of a conventional solenoid winding.
Figure 3:
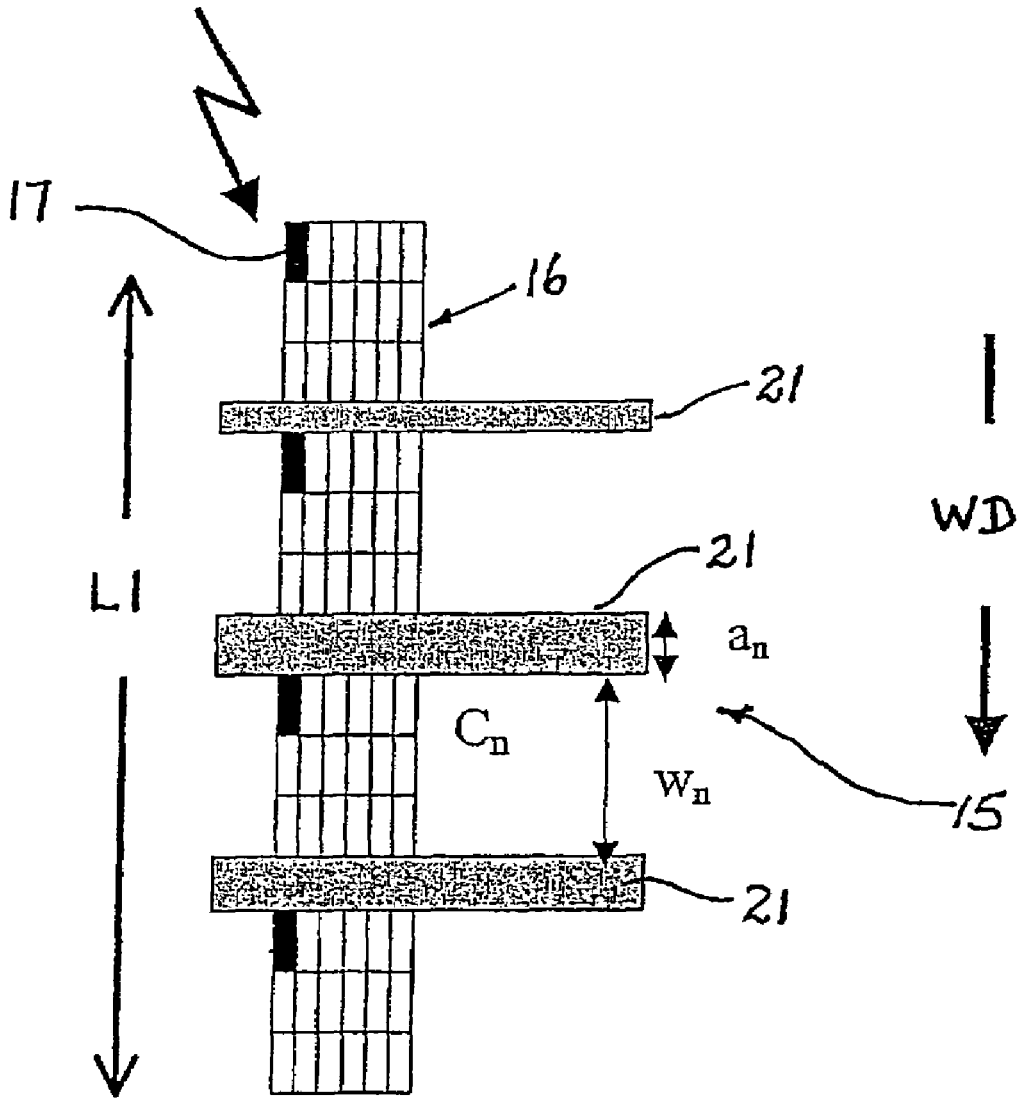
FIG. 3 shows a cross-sectional schematic view of one side of a winding according to one embodiment of the present invention.

Referring to FIG. 3 of the drawings, the transformer winding 15 consists of a number of vertically spaced winding groups 16. Each winding group 16 is wound in a solenoid-type manner from a conductor 17 in winding direction WD. In this simple illustration, each layer comprises three turns and there are six layers forming the winding group 16.

In the hybrid disk-solenoid winding shown in FIG. 3, the voltage between any two windings within a solenoid group is reduced by the number of solenoid groups in the whole stack, n. The radial extent of the winding is the same as if it were wound as a conventional solenoid, hence, the voltage stress is reduced by the same amount. If there were n solenoid groups, then the stress within each between the first and last turn would be reduced by a factor of n compared to the conventionally wound technique. The L1 test voltage would distribute in a complex way but would-still be reduced by a factor approaching n.

The number of solenoid groups would be controlled by the unit length of High Temperature Superconductor (HTS) tape available so that no joints occurred in any solenoid wound group. The distance between the solenoid groups is determined as for a disk winding and depends on the voltage stress. The number of joints is significantly lessened compared to double pancakes because many more turns are included in each solenoid group.

An additional benefit is that each coil has a better effective cooling since two faces are available for heat dissipation. If this is not required, then optionally a solid dielectric may be placed between the solenoid groups to increase the electrical strength. Alternatively, a barrier of solid dielectric consisting of an annulus 21, may be placed between the solenoid groups, as shown in FIG. 3.

Additionally, the spacing between the $n^{th}$ solenoid and the $n+1^{th}$ solenoid, $a_n$, may be designed and optimised with constraints as in equations 1 and 2 below such that the individual coil to coil partial capacitances, $C_n$, between same results in a lightning impulse (L1) distribution across the length of the whole coil which is uniform and favourable to HV transformers.

$$a_{n+1}>a_n \quad \text{Eq. 1}$$

$$C_{n+1}>C_n \quad \text{Eq. 2}$$

Additionally, the winding length of each solenoid, $w_n$, is such that the L1 creep strength of the dielectrics is met across the coil face.

Additionally, the L1 distribution, which is effected but not exclusively by parameters $w_n$, $a_n$, $C_n$ is designed such that the voltage between the n and $n+1^{st}$ coils is such that it meets the L1 breakdown strength of the dielectric between them.

Additionally, the voltage between the n and n+1$^{st}$ coils is such that it meets the power frequency breakdown strength of the dielectric between them.

Further, individual solenoid groups may be replaced if they fail or do not meet specification whereas in a conventional solenoid winding, the whole coil would need to be replaced. This reduces the manufacturing risk.

It will be appreciated that further embodiments and exemplifications of the invention are possible without departing from the spirit or scope of the invention described.

The invention claimed is:

1. A method of producing a winding for a high voltage transformer including the steps of:

forming a predetermined number of spaced conductor winding groups joined together to form a single winding of the transformer; and winding each spaced winding group as a solenoid-type winding having, in section, a plurality of interwoven axial columns and radial rows from a predetermined number of turns of conductor, wherein a spacing ($a_n$) between an n$^{th}$ solenoid-type winding and an (n+1)$^{th}$ solenoid-type winding is greater than a spacing ($a_{n+1}$) between the (n+1)$^{th}$ solenoid-type winding and an (n+2)$^{th}$ solenoid-type winding, an individual coil to coil partial capacitance ($C_n$) between the n$^{th}$ solenoid-type winding and the (n+1)$^{th}$ solenoid-type winding being greater than an individual coil to coil partial capacitance ($C_{n+1}$) between the (n+1)$^{th}$ solenoid-type winding and the (n+2)$^{th}$ solenoid-type winding, thereby providing a substantially uniform lighting impulse distribution across the transformer.

2. A method according to claim 1 further including the step of selecting the number of spaced winding groups and number of turns of each winding group such that a predetermined voltage stress for a given operating voltage of the transformer is not exceeded.

3. A method according to claim 1 wherein the winding is formed from high temperature superconductors.

4. A method according to claim 1 including the step of forming each winding group from a single uninterrupted length of conductor.

5. A method according to claim 1 wherein each conductor turn includes a plurality of conductors.

6. A method according to claim 1 wherein the winding groups are spaced and stacked vertically.

7. A method according to claim 6 including the step of winding each winding group in sequence vertically.

8. A method according to claim 1 wherein each solenoid-type winding has a winding length such that a lighting impulse creep strength of dielectrics is met across a coil face of the transformer.

9. A method according to claim 1 wherein a voltage between the n$^{th}$ and (n+1)$^{th}$ solenoid-type windings meets a lighting impulse breakdown strength of a dielectric between the n$^{th}$ and (n+1)$^{th}$ solenoid-type windings.

10. A method according to claim 1 wherein a voltage between the n$^{th}$ and (n+1)$^{th}$ solenoid-type windings meets a power frequency breakdown strength of a dielectric between the n$^{th}$ and (n+1)$^{th}$ solenoid-type windings.

11. A high voltage transformer comprising:

a winding including a predetermined number of spaced winding groups joined together to form a single winding of the transformer, each spaced winding group being solenoid wound from a predetermined number of turns having, in section, a plurality of interwoven axial columns and radial rows, wherein a spacing ($a_n$) between an n$^{th}$ winding group and an (n+1)$^{th}$ winding group is greater than a spacing ($a_{n+1}$) between the (n+1)$^{th}$ winding group and a (n+2)$^{th}$ winding group, an individual coil to coil partial capacitance ($C_n$) between the n$^{th}$ winding group and the (n+1)$^{th}$ winding group being greater than an individual coil to coil partial capacitance ($C_{n+1}$) between the (n+1)$^{th}$ winding group and the (n+2)$^{th}$ winding group, thereby providing a substantially uniform lighting impulse distribution across the transformer.

12. A transformer according to claim 11 wherein the transformer is a superconducting transformer.

13. A transformer according to claim 11 wherein each winding group has a winding length such that a lighting impulse creep strength of dielectrics is met across a coil face of the transformer.

14. A transformer according to claim 11 wherein a voltage between the n$^{th}$ and (n+1)$^{th}$ winding groups meets a lighting impulse breakdown strength of a dielectric between the n$^{th}$ and (n+1)$^{th}$ winding groups.

15. A transformer according to claim 11 wherein a voltage between the n$^{th}$ and (n+1)$^{th}$ winding groups meets a power frequency breakdown strength of a dielectric between the n$^{th}$ and (n+1)$^{th}$ winding groups.

* * * * *